United States Patent [19]

Nakatsu

[11] 4,187,787

[45] Feb. 12, 1980

[54] ROPE-SUSPENDED SHELVING UNIT

[76] Inventor: Daniel T. Nakatsu, 117 Westwood Dr., San Francisco, Calif. 94112

[21] Appl. No.: 917,107

[22] Filed: Jun. 19, 1978

[30] Foreign Application Priority Data

Oct. 5, 1977 [JP] Japan ..... 52/134175[U]

[51] Int. Cl.[2] ..... A47B 57/00

[52] U.S. Cl. ..... 108/96; 108/106; 108/149

[58] Field of Search ..... 108/96, 92, 106, 149

[56] References Cited

U.S. PATENT DOCUMENTS

| | | | |
|---|---|---|---|
| 2,556,105 | 6/1951 | Rhett | 108/106 |
| 3,025,970 | 3/1962 | Ostrum | 108/96 |
| 3,799,072 | 3/1974 | Slaboden | 108/149 X |

FOREIGN PATENT DOCUMENTS

| | | | |
|---|---|---|---|
| 451714 | 4/1913 | France | 108/149 |
| 290159 | 10/1928 | United Kingdom | 108/149 |

*Primary Examiner*—James C. Mitchell

*Attorney, Agent, or Firm*—Laurence R. Brown

[57] ABSTRACT

A rope-suspended shelving unit wherein a plurality of generally rectangular shelves each of which has a front and rear edge are provided with first holes respectively in the four corners or only in the rear two corners. A second hole is substantially in the middle between one of the rear holes and either the respective front hole or the front edge. A third hole is substantially in the middle between the second hole and the respective front hole or front edge. The holes are adapted so that a rope, chain, cable or the like can pass through them so as to maintain the shelves in layered relationship at predetermined yet adjustable intervals. An elastic stabilizer is arranged on the part of the rope or the like in contact with the rear edge of the shelf so that the rope is fixed on the back side of the shelf in the lowermost step so that no receiving metal fixture is required and the formation is simple and stable in contact with the wall. An elastic bushing is affixed in the holes to further prevent slippage of the rope in contact with the shelves.

10 Claims, 13 Drawing Figures

ROPE-SUSPENDED SHELVING UNIT

FIELD OF THE INVENTION

This invention relates to a rope-suspended shelving unit adapted to be hung on a wall or a room partition.

DESCRIPTION OF THE PRIOR ART

In a conventional shelving unit affixed to a wall, a number of metal receiving or supporting fixtures are used to affix the unit to the wall, to support the shelves and to make the shelves adjustable in their height level. However, the metal fixtures are not easy to install, besides being costly to the user, and they make moving of the unit to another location difficult or impossible without considerable skill, labor time or labor cost.

SUMMARY OF THE INVENTION

Accordingly, an object of the present invention is to provide a rope-suspended shelving unit wherein the distance between the component shelves can be freely adjusted without requiring complicated receiving metal fixtures and wherein the unit is economical and has a simple structure having high stability.

Further objects and advantages of the present invention will become apparent as the following description proceeds and the features of novelty characterizing the invention will be pointed out with particularity in the claims annexed to and forming a part of this specification.

For a better understanding of the present invention reference may be had to the accompanying drawings wherein the same reference numerals have been applied to like parts and wherein:

DETAILED DESCRIPTION OF PREFERRED EMBODIMENTS

Figure 1:
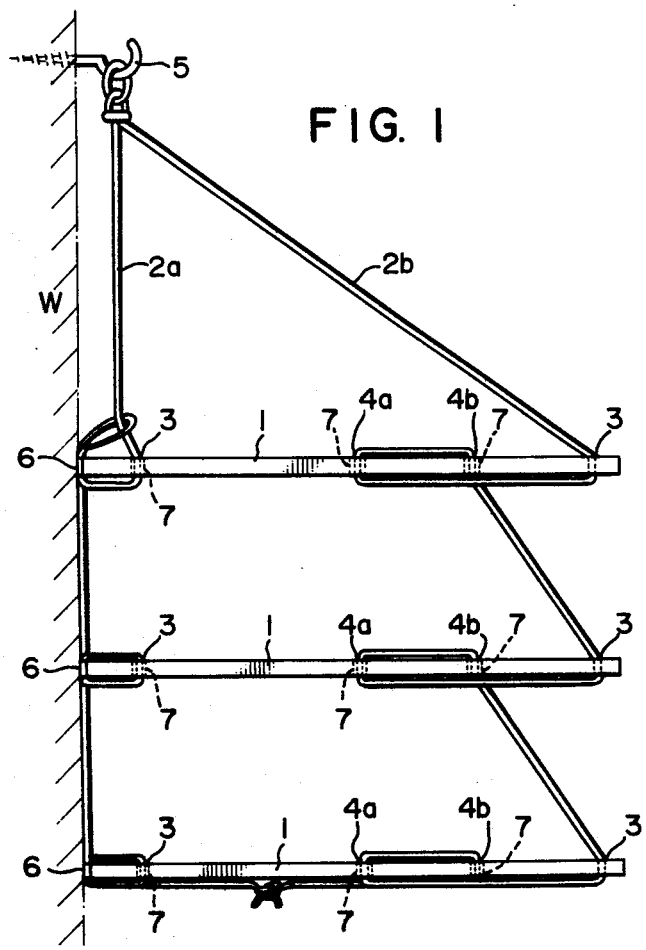
FIG. 1 is a side view showing an embodiment of a rope-suspended shelving unit according to the present invention.
Figure 2:
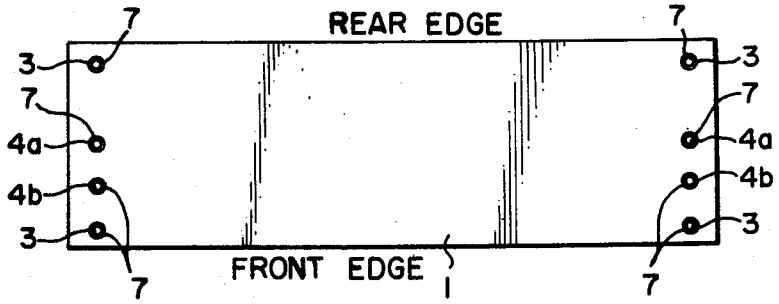
FIG. 2 is a plan view of the shelf shown in FIG. 1.
Figure 3A:
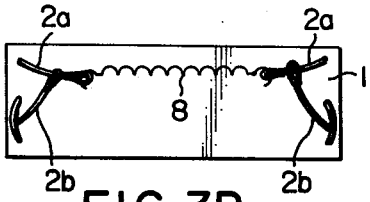
FIGS. 3A–D are bottom views showing embodiments of devices for fixing ropes or the like on the shelving unit at the respective lowermost steps.
Figure 3C:
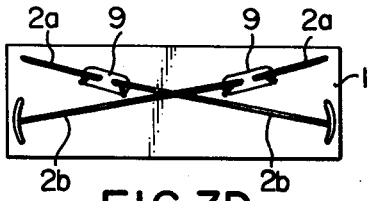
Figure 3B:
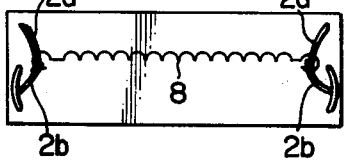
Figure 3D:
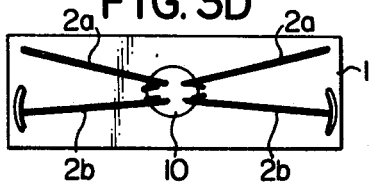

Referring to FIG. 1, there is shown a generally rectangular shelf 1 provided with first holes 3 disposed at the respective four-corners for having lines 2*a* and 2*b* passing respectively therethrough. A second hole 4*a* is disposed substantially in the middle between a pair of front and rear holes 3 and a third hole 4*b* is disposed substantially in the middle between the second hole 4*a* and the front first hole 3 with a line 2*b* passing through each.

A plurality (three in the drawing) of the shelves 1 provided with the holes 3, 4*a* and 4*b* are arranged above and below at proper intervals. The rear rope 2*a*, among the ropes hung on right and left hangers 5, is passed through the hole 3 in the rear part of the shelf 1 in the uppermost step so as to be substantially vertical, is once returned upward past the rear edge of the shelf 1, is looped around the same rope 2*a* and is again passed downward past the rear edge of the uppermost step and the second step, upward from below through the rear hole 3 and downward past the rear edge of the shelf 1 in the second step. The rope is next passed around and under the respective rear edge of shelf 1 of the succeeding lower step, upward through the rear hole 3 and then downward past the rear edge of the shelf, to the outside of descending rope 2*a*.

In order to prevent rolling of the shelf 1 and side-sway of the unit, an elastic trapezoidal or rectangular stabilizer 6 is fitted to the rope 2*a* and is arranged in the position of the rope 2*a* in contact with the rear edge of the respective shelf 1 as will be described in more detail hereinafter.

Referring to FIG. 1, the front rope 2*b* hung on each of the right and left hangers 5 is passed through the front first hole 3 of the uppermost step of the shelf 1 from above, is then passed through the second hole 4*a* from below, is passed through the third hole 4*b* from above, and is passed in a like manner through the front hole 3 in the shelf 1 in the next step in turn to hold the lower shelf 1 in the front part the same as in case of the shelf 1 in the uppermost step.

Below the shelf 1 in the lowermost step, the ends of the respective ropes 2*a* and 2*b* can be secured together. The right and left ropes 2*a* and 2*b* may be respectively looped at the ends and retained with elastic straps or plastic plates as shown in FIGS. 3A–3D. The right and left ropes may be fixed so as to be pulled with an elastic strap or a spring 8; the right and left ropes may be made to intersect with each other, wound and passed through holes made in plasic plates 9; or the ropes may be fixed to one plate 10.

Figure 5:
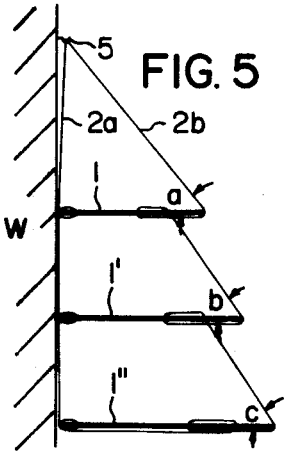
FIG. 5 is a side view showing another embodiment of the rope-suspended shelving unit shown in FIG. 4.
Figure 4:
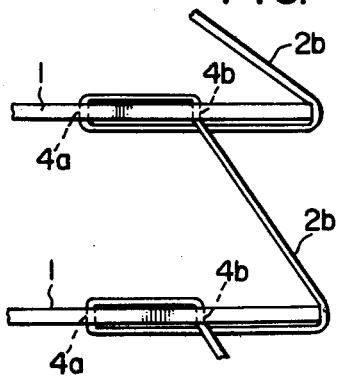
FIG. 4 is a partial side view showing another embodiment of the present invention.
Figure 7:
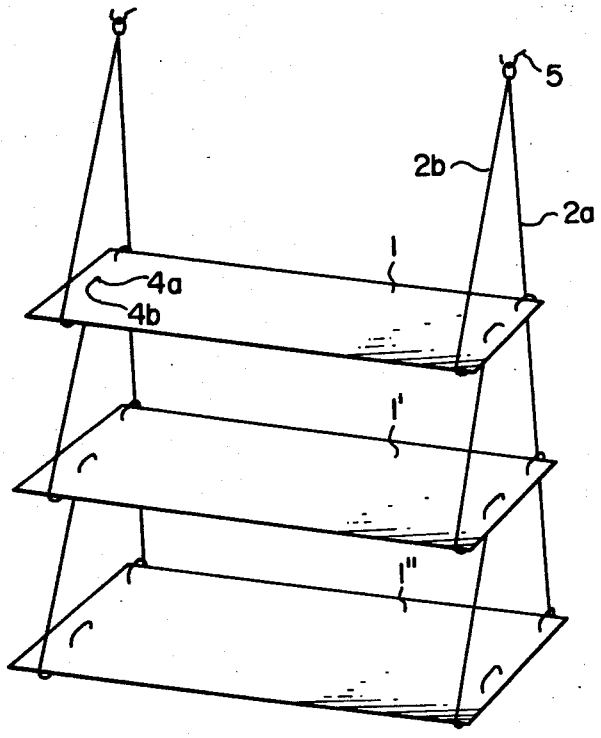
FIG. 7 is a perspective view of the rope-suspended shelving unit showing the embodiments of FIG. 5.

Referring to an alternate embodiment shown in FIGS. 4, 5 and 7, there is no front first hole 3, and the front rope 2*b* is passed around and under the front edge and upward through the second hole 4*a* from below, passed from above through the third hole 4*b* on the outer side of the rope previously passed through hole 4*a*, and then past the front edge of the shelf 1 in the next step in turn. The rope 2*b* passed from above through the third hole 4*b* and passed or wound on the front edge of the next shelf below will not separate from the shelf 1. Further, if the shelves 1, 1′ and 1″ are made progressively greater in depth as shown in FIG. 5, with the rope 2*b* wound around the front edge of the shelves, the pressure of the shelves against the wall will increase and will stabilize them. In such case, in order to balance the stresses on the wall, the angles "b" and "c" made by the front rope 2*b* with the shelves in the lower steps should be substantially equal, however, the angle "a" with the shelf 1 in the uppermost step is an exception to the rule.

Figure 6A:
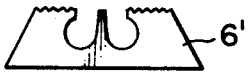
FIGS. 6A–D are plan views showing different embodiments of the stabilizers.
Figure 6C:
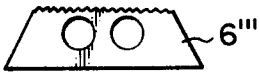
Figure 6B:
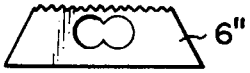
Figure 6D:
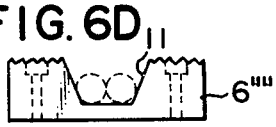

Referring to FIG. 1, an elastic vinyl holed cube 6 is fitted to the part of the rear rope 2*a* in contact with the rear edge of the shelf 1, forming a contact of the rope 2*a* with the wall W, and preventing rolling of the respective shelf 1 so that even if the shelf 1 is pushed down on the front edge, it will not rise on the rear edge. The friction of the elastic vinyl cube against the wall will also restrict or prevent side-sway of the shelving unit. Referring to FIGS. 6A–6C, similarly, if an elastic vinyl trapezoidal stabilizer 6′, 6″ or 6‴ is used and is glued or otherwise secured such as by a nail or the like along the long side to the rear edge of the shelf 1 and is serrated on the wall-engaging side, rolling of the shelves and side-sway of the unit will also be prevented. In such case, the shape of the hole should allow free passage of the rope in winding the rope around the rear edge of the shelf. Additionally, as shown in FIG. 6D, a rectangular stabilizer 6'''' provided with a groove 11 for inserting and passing the rope therein and fitted to the rear edge of the shelf 1 with wood screws or the like has similar or greater effect.

Therefore, since the entire body is stabilized and the front rope **2*b* is passed at an angle inclined to the shelf, the stability against the wall W will be high and the shelf 1 will not readily move up, down or roll upon application of an upward applied force. Additionally, a vinyl tube or a flanged bushing 7 fitted in each of the holes 3, 4*a* and 4*b* in the shelf 1, will prevent slippage of the rope 2*a* or 2*b* against the shelf 1**, and a further stabilization of the rope-suspended shelving unit will be obtained. Needless to say, a chain, cable or the like may be used instead of the rope. Further, if required or desired, a nail may be struck into the wall through the rear rope to further prevent rolling of the shelf or side-sway of the unit.

As described above, according to the present invention, there is obtained a stable inexpensive rope-suspended shelving unit capable of relatively easy relocation in intact manner and embodying a simple structure comprised of the passing of ropes through holes in shelves without requiring any special metal fixtures to receive, support or stabilize the component shelves.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent of the United States is:

1. A suspended shelving unit for hanging a set of shelves downwardly along a wall from a hook assembly at adjustable spacing intervals comprising in combination, at least two shelves each having an edge disposable away from said wall and a wall engaging edge and defining a first set of apertures for receiving a first flexible line at the wall engaging edges and a second set of apertures for receiving a second line at the edge away from said wall, a first line fed through the first apertures at the wall engaging edges and looped about the shelf edge at each aperture to support and space the shelves a predetermined distance apart forming a generally parallel relationship to the wall, a second flexible line fed through the second set of apertures and looped about the shelf edge at each edge away from said wall to support and space the shelves said predetermined distance apart, a hook assembly engaging both lines at their uppermost extremities with said second line defining an acute angle with said wall toward the uppermost shelf thereby to provide a force by weight of the shelves on said second line tending to hold the shelves against the wall, whereby the loops of said flexible lines about said shelves may be rearranged to change said predetermined distance between adjacent shelves.

2. A shelving unit as defined in claim 1 wherein said second flexible line is looped about the shelf edge disposable away from said wall.

3. A shelving unit as defined in claim 1 having an elastic stabilizer member disposed on said wall engaging edge encompassing said line and providing increased friction against lateral movement of shelves against said wall.

4. A shelving unit as defined in claim 1 wherein said stabilizer member encompasses said first line.

5. A shelving unit as defined in claim 3 secured to the wall solely at said hook assembly, with said shelves suspended therefrom by said lines.

6. A shelving unit as defined in claim 1 having elastic bushings disposed within each aperture to receive the respective lines therethrough.

7. A shelving unit as defined in claim 1 wherein the second flexible line from said first shelf to the second shelf is disposed at an acute angle to said wall to thereby urge the lowermost shelf toward contact with said wall.

8. A shelving unit as defined in claim 5 wherein the two shelves have differing widths and the wider shelf is disposed lowermost.

9. A shelving unit as defined in claim 1 wherein the second set of apertures comprises at least two apertures through which the line is looped for supporting the edge of each shelf disposable away from said wall.

10. A shelving unit as defined in claim 1 wherein both said lines are extended through the bottommost shelf, and resilient means below the bottommost shelf engaging both the respective two lines and biasing the respective two lines toward each other.

* * * * *